United States Patent [19]

Hamilton et al.

[11] 3,941,095

[45] Mar. 2, 1976

[54] ANIMAL HANDLING APPARATUS

[75] Inventors: Ian Robert Hamilton, Illabo; David Murray Underwood Alley, Bethungra, both of Australia

[73] Assignee: Fire Fighting Enterprises Limited, Ermington, Australia

[22] Filed: Sept. 16, 1974

[21] Appl. No.: 506,324

[52] U.S. Cl. ..... 119/103

[51] Int. Cl.[2] ..... A61D 3/00

[58] Field of Search ..... 119/103; 17/1 A

[56] References Cited

UNITED STATES PATENTS

| | | | |
|---|---|---|---|
| 3,276,433 | 10/1966 | Tougas et al. | 119/103 |
| 3,324,503 | 6/1967 | Clair | 119/103 X |

*Primary Examiner*—Hugh R. Chamblee

*Attorney, Agent, or Firm*—George F. Smyth

[57] ABSTRACT

This invention relates to an animal handling machine, in which at least one animal may be held for operation or inspection in an operating station while another animal is trapped in a receiving station. On completion of an operation on the first-mentioned animal, the machine may be operated to simultaneously transfer the trapped animal in the receiving station to the operating station and transfer the first-mentioned animal from the operating station to a release station, thereby allowing for the operation or inspection of individual animals or a large number of such animals in a continuous manner.

11 Claims, 5 Drawing Figures

ANIMAL HANDLING APPARATUS

This invention relates to an animal handling machine and in particular a machine capable of handling at least two animals at a time.

Conventional animal handling machines may fall into two main categories, namely that required for immobilizing the animal in the field such as cattle crushes used for branding and other necessary and routine operations, and those more suitable for supporting the animal for specialist operations such as a veterinary's operating table which may be moved about two axes or more.

Further there is a requirement for animal handling aids which will assist operators and attendants in providing a quick and efficient means of attending to a large number of animals that are involved in a particular process or treatment. For smaller animals such as sheep the attendant is required to man-handle the sheep during the operation, and considering the large number of sheep that normally have to be handled, the operation becomes exceedingly arduous in nature and costly in manpower. For large animals such as cattle, it is a time consuming operation to place them in the conventional cattle crush or even to man-handle them during branding, foot inspections or the like.

The object of the invention is to provide a means for handling a large number of animals quickly and efficiently and generally alleviating the arduous nature of the operation as associated with conventional methods.

The invention in a general form is an animal handling apparatus having an animal receiving station, operation station and release station, said apparatus comprising means for trapping and means for holding an animal in the receiving station, means for transferring the animal from the receiving station to an operation station, means for inverting the animal, means for maintaining an animal in said operation station while another animal is trapped at the receiving station, means for transferring the first mentioned animal from the operation station to the release station following completion of an operation thereon, whereby at least one animal is continuously held in said apparatus.

A preferred embodiment of the invention will now be described by way of example with reference to the accompanying drawings, wherein.

Figure 1:
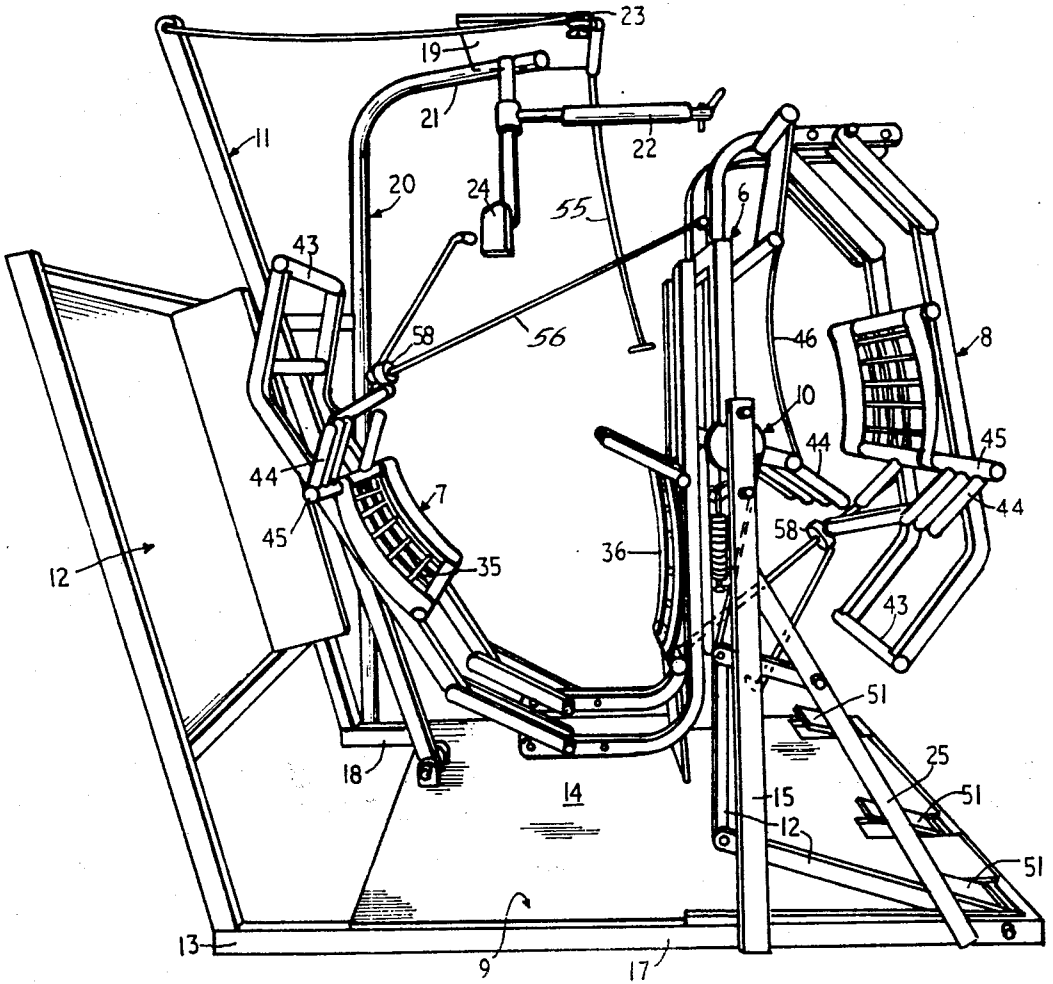
FIG. 1 is an end elevation in perspective of a sheep handling machine according to the present invention, suitable for crutching and foot inspection operations.

The basic requirement of the sheep handling machine is to present the sheep supported on its back in a cradle with its head and eyes, crutch and belly exposed and feet extended to the shearer or operator. Further, as illustrated in FIGS. 1 and 2, the cradle may consist of the following major basic components or assemblies; a rotating frame 6, two cradle attachments 7 and 8 supported from the rotating frame; a base frame 9 supporting the bearings in which the rotating frame may revolve; a foot operated latch and detent arrangement 10 whereby the rotating frame may be locked in a preselected position; and a trapping mechanism 11 and guide curtain or panel 12.

The rectangular base frame 9 of the cradle is fabricated from conventional steel tubing 13 of rectangular cross section and to which is secured a checker plate base plate 14. Mounted to the base frame are two upright bearing support posts 15 and 16 of similar overall heights. One post 15 is secured to one end member 17 and the other post 16 to a second end member 18 of the base frame, both posts being displaced off-center with respect to their base frame end members by similar amounts. A further substantially upright post 20 is secured to the base frame member 18 at one corner thereof, the post 20 being provided with a horizontal tubular beam 21. In order to provide a container for the operator's miscellaneous tools, a horizontal steel plate 19 in a form of a tray is secured to the beam. The horizontal tubular beam and tray provide a means of support for leg holding devices 22, a trapping lever draw-rope pulley 23, a cradle release cam mechanism 24 and other miscellaneous equipment as required. Also a brace member 25 is attached to and between each upright post and its respective base frame member to give additional support to the upright posts.

Figure 3:
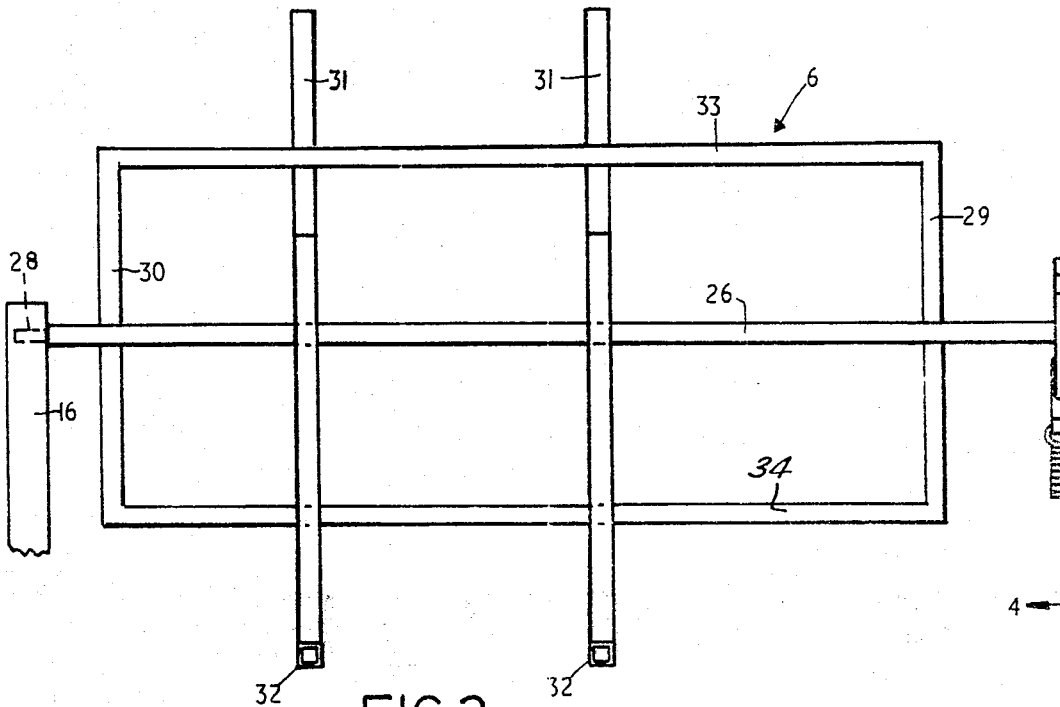
FIG. 3 is a side elevation of the rotatable frame only of the machine.

Referring now to FIG. 3, the rotating frame 6 consists of a center tubular member 26 about which the frame revolves and at each end of which is provided a stub shaft 27 and 28 which in turn is supported in a bearing mounted at the top of each upright bearing support post 15 and 16 respectively. A rectangular frame is secured and displaced to one side of the rotating center member 26, and the frame rotates about an axis through the center of its end-members 29 and 30. Two pairs of cradle pivot and support members 31 and 32 are attached to and between the side members 33 and 34 of the rotating rectangular frame and the centre rotating member 26, and are aligned perpendicular to the axis of rotation.

Figure 2:
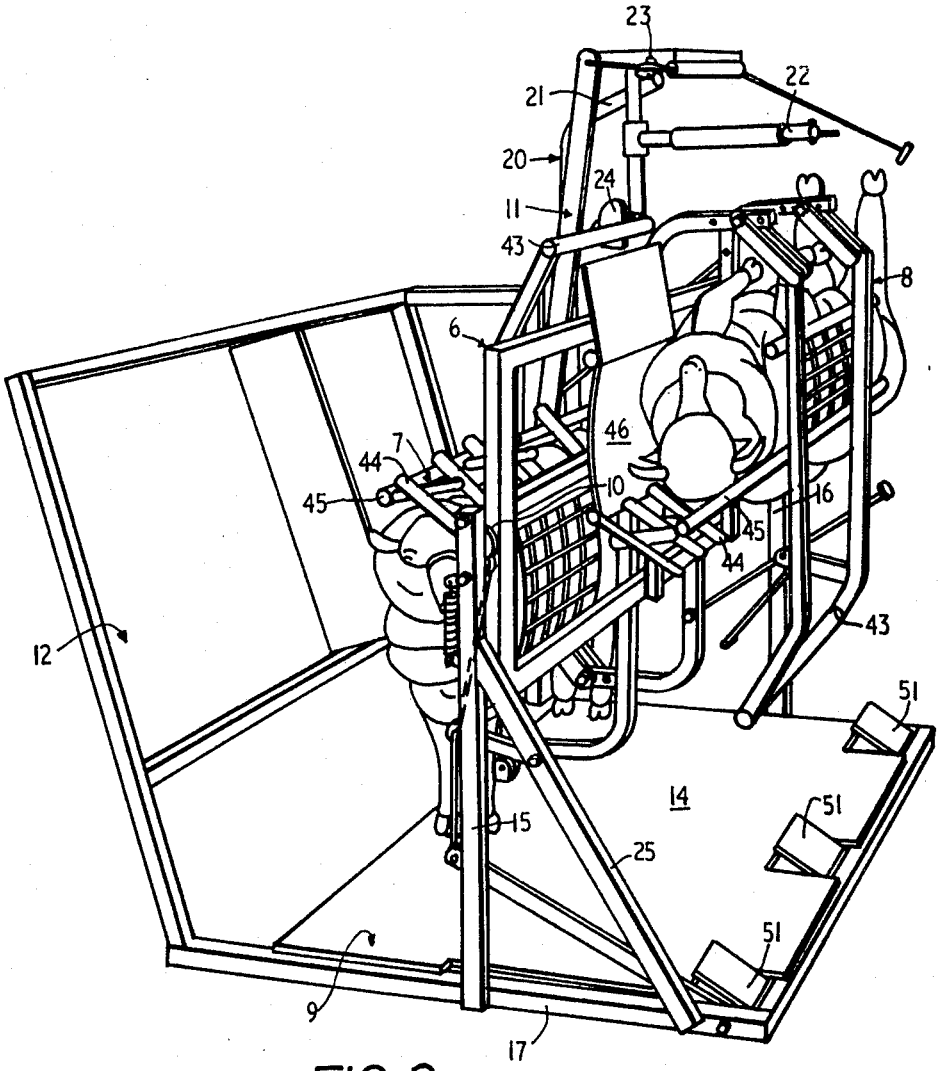
FIG. 2 is a similar perspective view of FIG. 1, but showing sheep held in both holding means of the machine.
Figure 5:
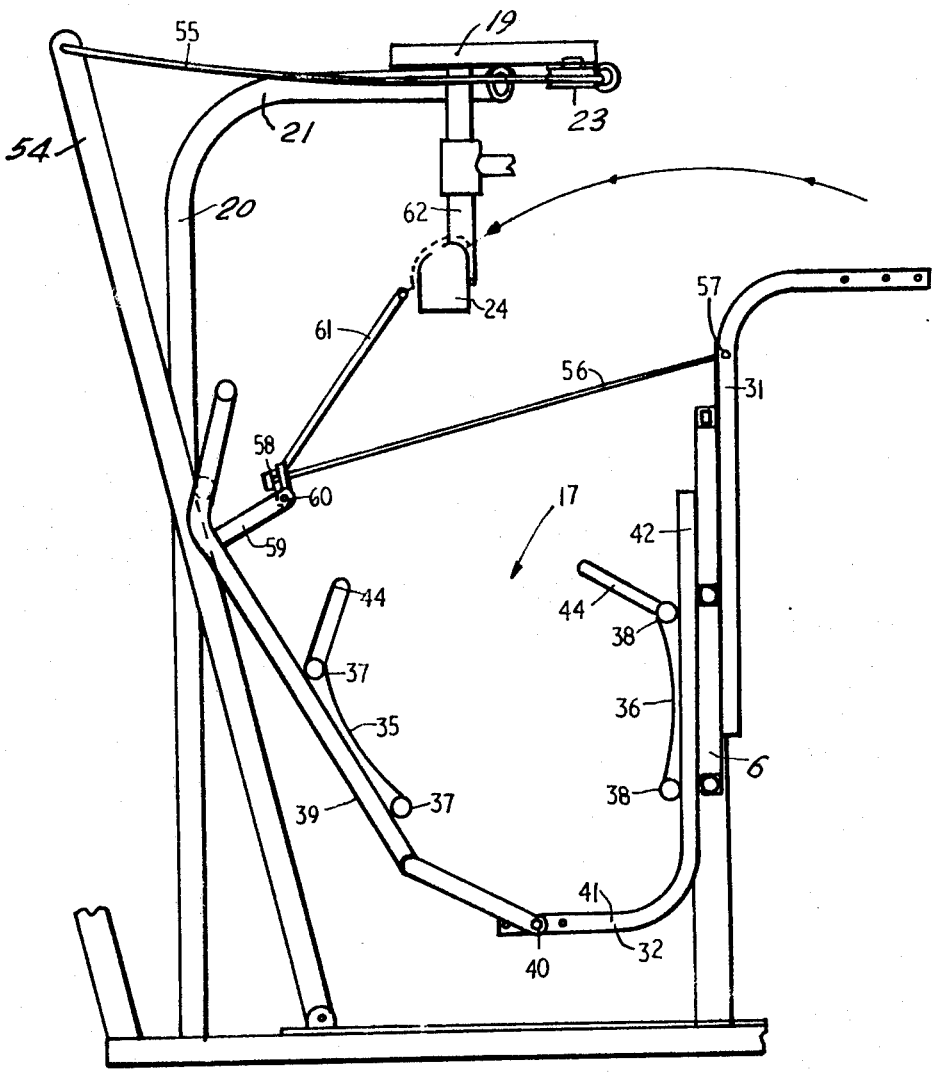
FIG. 5 is an end elevation of one side only of the machine illustrating the automatic release mechanism of the holding means.

A cradle 7 supports the sheep by means of a controlled crushing action between two curved side walls 35 and 36 as illustrated in FIGS. 1, 2 and 5, the side walls 35 and 36 being supported from two tubular members 37 and 38 respectively. The side walls may be formed from open wire mesh attached to and between the tubular members 37 or 38. The side walls are curved to generally suit the profile of the handled sheep. The crushing action, as shown in FIG. 5, is achieved by means of two similar pairs of cradle crushing levers 32 and 39, the levers of each pair being spaced apart and parallel and pivotally joined at one end 40 to the levers of the other pair. Thus when one pair of lever members 39, known as the swinging members, is rotated relative to and towards the other pair of lever members 32, known as the fixed members, the action causes an item located between the levers to be held or crushed.

The tubular members 37 and 38 of the two curved side walls 35 and 36 of the cradle are attached to and between the two pairs of cradle crushing levers 39 and 32 respectively. The fixed members 31 and 32 of each pair of cradle crushing levers are crank shaped, each provided with two straight sections 41 and 42 attached at approximately right angles to each other, and forming the cradle pivot and support members 31 and 32 which are mounted on the revolving rectangular frame 6. The cranked straight section 41, to which is pivoted a swinging cradle crushing lever member 39, provides a means of spacing apart the two side walls 35 and 36 of a cradle, and adjustment to suit the size of sheep to be handled may be made by moving the pivot point 40 along the cranked section 41 as required.

Referring to FIGS. 1 and 2, the two cradle assemblies 7 and 8 are mounted to the revolving frame 6 such that when the revolving frame is in a vertical plane; one cradle 7, located on one side and at the bottom of the rotating frame, is presented open to a run of sheep; while the other cradle 8, located on the other side and at the top of the rotating frame, is presented to the operator with the cradle top and bottom sides inverted with respect to the cradle in the open position; hence, by trapping and supporting a sheep in a cradle open to the run and then revolving the rotating frame and assembly through approximately 180° by means of handles 43 attached to the frame 6, the sheep may be lifted and rotated from its standing position to a new raised and inverted position with its feet extending upwards at a convenient working level to suit an operator, shearer or inspector. The other cradle 8 is now at the cradle open position ready to receive a second sheep. On completion of the operation on the first sheep, the frame 6 is rotated through a further 180° to return the sheep to the cradle open position, and simultaneously the second sheep is presented in the operating position and so the cycle is repeated.

As a result of revolving the sheep to an inverted position, it is necessary to support its head by means of protruding members 45 which are extensions of the cradle tubular members 37 and 38. Attached to the protruding members 45 are a number of finger members 44 which interweave and over-lap behind the sheep's head when the cradle walls 35 and 36 are drawn together thus providing support for the head in the operating position.

Further in an operation such as removing the wool from around the eyes of the sheep, it is necessary to prevent the head from moving. As illustrated in FIGS. 1 and 2, removable extension walls 46 may be provided for attachment to the cradle side walls 35 and 36 to crush and support the head, however wire mesh is not used in the fabrication of the head crushing walls but thin metal sheet or plastic as the sheep's horns may become entangled.

Figure 4:
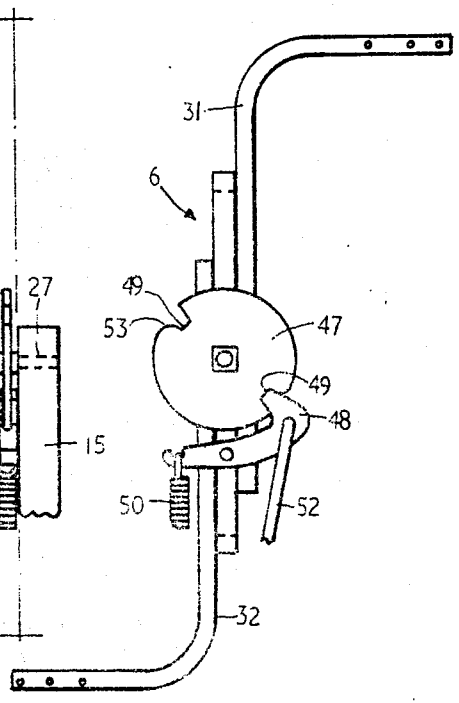
FIG. 4 is an end elevation on the line 4—4 in FIG. 3.

Referring to FIG. 4, the rotating assembly may be locked in both the cradle open and operating positions by means of a disc 47 secured to and concentric with the rotating frame bearing shaft 26, and a spring latch 48. The disc has two radial slots 49 at approximately 180° to one another. The latch, which is pivotally supported at its center from one of the bearing support posts, engages in a slot to prevent the disc from rotating. The latch is held in engagement with the disc by means of a spring 50 attached to and between one end of the latch and a bearing support post. Release of the latch is achieved by means of a foot pedal 51 and rod linkage 52 which may be activated by the operator and is mounted on the base frame (see FIGS. 1 and 2). One radial wall 53 of each slot is formed with a radius to blend with the disc circumference and assists rotation of the frame in a preferred direction on release of the latch.

It should be noted that in order to encourage sheep or any animal to enter a trap, enclosure, or the like under minimal coercion, it is essential for the animal to have an apparent avenue of escape ahead. It is desirable to provide a steady flow to the handling machine and therefore it is important that when the cradle opens to receive the next sheep, it should not cause the sheep to balk. If the cradle or trap appears to give the only clear outlet, the sheep will invariably attempt to run through, providing the opportunity to close the cradle, trapping the animal. Further, while the machine is in continuous cyclic operation and at an instant when a sheep is returned to its initial trapped position and then released, the said sheep will see an escape route ahead, rush out and this encourages the next sheep to follow, which in turn will be trapped.

FIGS. 1 and 5 illustrate the means which is used in this preferred embodiment of the invention to close the cradle at the appropriate instant to trap the sheep. The trapping means comprising a generally upright trapping lever 54 which is pivotally attached at one end to the base frame adjacent to the cradle 7 when in its open position. A laborer assisting the flow of sheep in the run may draw on a rope 55 or the like, which passes through a pulley 23 secured to the horizontal tubular beam 21 or steel plate 19 attached to post 20 mouunted on the base frame. Rope 55 may be tied to the other end of the trapping lever; pulling the rope causes the lever to bear on the outside of the swinging cradle support members 39, causing the cradle to crush the sheep trapped within and hence withstraining and supporting the sheep. To prevent the sheep in the run from by-passing the cradle when the trapping lever is in its crushing position a canvas or steel sheet screen 12 may be provided and attached between two upright posts secured at the ends of the side members of the base frame. In the case of a flexible canvas screen, a center portion of the screen may be attached to the trapping lever as illustrated in FIG. 1, thereby preventing sheep from by-passing the machine. However, curved wire inserts are required in the screen to hold the screen away from the cradle in order to minimize any obstruction to the sheep while the machine is rotated.

Once the cradle walls 35 and 36 have been drawn together crushing and trapping the sheep, a locking means is provided to retain the cradle 7 in the crushing position on release of the trapping lever and while the cradle is rotated. This locking means comprises a tie-rod 56 (FIG. 5) pivotally connected at one end 57 to the rotating frame 6 and automatically and adjustably held at the other end by means attached to the end of the swinging cradle support and crushing member 39 remote from the pivoted end 40. The tie-rod holding means comprises a plate or disc 58 which has a hole formed through it, such as a washer, in the preferred embodiment. The size of the hole is larger than the diameter of the tie-rod 56, thus allowing the rod to slide in the hole in the washer. The washer is pivotally attached adjacent its circumference to a bracket 59 which is secured to the swinging cradle support and crushing member 39. When the washer is rocked about its pivot 60, a jamming or locking action is created between the tie-rod and the edges of the wall of the hole in the washer; thus the locking position may be fully adjustable along the length of the rod. Further, to provide automatic locking and release, a cam follower connecting rod 61 is attached at one end to the washer at its circumference diametrically opposite to the pivot point. The connecting rod 61 is permanently urged by means of a spring in such a direction so as to cause locking if not restrained. A cam plate 24 is supported from a member 62 attached to the horizontal tubular beam 21 or steel plate 19 which is secured to post 20. The cam plate 24 is located and so shaped to displace the connecting rod 61 and release the tie-rod locking washer 58 and hence the tie-rod 56 at a selected cradle release position. The cradle release position is a point in the handling machine's cycle of operation, at which the sheep is returned to the run after completion of the inspection, crutching or the like operations.

Those skilled in the art will note that the above preferred embodiment has been described in terms of a machine for a right-handed operator. A machine according to the invention may readily be adapted to suit a left-handed operator if required.

We claim:

1. An animal handling apparatus having an animal receiving station, operating station, and release station comprising means for trapping and holding an animal in the receiving station, and means for inverting the animal and transferring it toward an operating station, maintaining it in the operating station while another animal is trapped and held in the receiving station, and transferring it toward the release station while the other animal is inverted and transferred toward the operating station including a base frame having means for providing a substantially horizontal axis, rotatable frame means mounted on said axis, a plurality of said trapping and holding means fixed to said rotatable frame means for movement therewith, and means for locking said rotatable frame means so that each of said trapping and holding means may be temporatily fixed in the receiving station and the operating station comprising disc means mounted for simultaneous rotation with said rotatable frame and having detent means located about the periphery thereof, equal in number to the number of said trapping and holding means, latch means pivotally mounted on said base frame adjacent the periphery of said disc means for selective engagement with said detent means, and linkage means, actuatable by an operator of the apparatus, connected to said latch means for selective disengagement of said latch means from said disc means to allow rotation of said rotatable frame.

2. An animal handling apparatus as claimed in claim 1 wherein said trapping and holding means is a crushing cradle having first and second side walls which are pivotally connected together adjacent one end thereof, whereby an animal placed therebetween is held when the two side walls are rotated towards and with respect to each other.

3. An animal handling apparatus as claimed in claim 2 wherein said first crushing cradle side wall is secured to the rotating frame and said second side wall is pivotable with respect to the rotating frame.

4. An animal handling apparatus as claimed in claim 3, wherein said animal trapping and holding means comprises, a trapping lever pivotally mounted at one end thereof to said base frame and adapted to bear against said second side wall to urge said second side wall towards said first side wall and said rotatable frame means, and means for restraining the two side walls in an animal holding position with respect to each other.

5. An animal handling apparatus as claimed in claim 4, wherein said means for restraining the two side walls in an animal restraining position comprises a locking member having a hole formed therethrough, said locking member being pivotally attached to and adjacent one end of said second side wall, said one end being remote from the pivotal connection of said side walls, said hole being so sized and shaped as to receive a tie-rod, a tie rod having one end thereof pivotally connected to said rotating frame means, urging means causing said locking member, in the absence of any other restraint, to rotate and lock against said tie-rod, a cam secured to said base frame, cam follower means attached to said locking member and adapted to engage said cam for releasing said locking member when said crushing cradle is returned to the release station.

6. An animal handling apparatus comprising a base frame, a rotatable frame supported on said base frame for rotation about a substantially horizontal axis and having a plurality of animal holding cradles attached thereto, each said cradle including a first and a second sidewall, said sidewalls being pivotally interconnected for relative movement lever means pivotally connected to said base frame and located so as to act against one of said first and second sidewalls to urge it toward the other of said sidewalls and trap an animal therebetween, means for actuating said lever means when an operator observes that an animal is in position to be trapped between said side walls, and means for releasably locking said side walls in positions relative to one another to hold an animal therebetweeen during rotation of said rotatable frame.

7. The handling apparatus of claim 6 including means for releasably fixing said rotatable frame in a number of positions equal to a predetermined number of animal holding stations.

8. The handling apparatus of claim 7 wherein said fixing means comprises means for providing detents equal in number to the number of stations into which said holding cradles are to be located in each cycle of operation, means for moving said detent providing means synchronously with said rotatable frame, latch means mounted on said base frame for engagement with said detent means, and linkage means actuatable by an operator to disengage said latch means from said detent means so that said rotatable frame means may be rotated.

9. The apparatus of claim 6 wherein said locking means comprises a locking member having an aperture therethrough, means for pivotally attaching said locking member adjacent an end of one of said side walls distal from the pivotal interconnection thereof, rod means pivotally mounted relative to said one of said side walls and extending through said aperture in said locking member in close relationship to the wall of said aperture, means for urging said locking member toward a position in which the wall of said aperture grips said rod means to prohibit relative movement therebetween, and means for forcing said locking member and said rod means into release positions to allow relative movement therebetween when said holding cradle is in a predetermined position relative to said base frame.

10. The apparatus of claim 9 wherein said forcing means comprises cam means and cam follower means, one of which is fixed relative to said base frame and the other of which is fixed for limited movement relative to said holding cradle.

11. The apparatus of claim 6 including means for providing the animal in each holding cradle with an apparent escape route when said holding cradle is opened, thereby encouraging a succeeding animal to enter said cradle when it sees the released animal escaping from said cradle.

* * * * *